United States Patent [19]

Housley

[11] Patent Number: 4,868,540

[45] Date of Patent: Sep. 19, 1989

[54] PROGRAMMABLE DOORBELL CONTROL

[76] Inventor: Todd B. Housley, 2920 Windsor Dr., Flower Mound, Tex. 75028

[21] Appl. No.: 73,456

[22] Filed: Jul. 15, 1987

[51] Int. Cl.[4] ..... G08B 27/00

[52] U.S. Cl. ..... 340/326; 340/392; 340/330

[58] Field of Search ..... 340/326, 331, 332, 330, 340/392, 393

[56] References Cited

U.S. PATENT DOCUMENTS

| | | | |
|---|---|---|---|
| 382,997 | 5/1888 | McTighe | 340/330 |
| 896,793 | 8/1908 | Baum | 340/330 |
| 1,231,537 | 6/1917 | Murphy et al. | 340/330 |
| 1,390,907 | 9/1921 | Heyroth | 340/326 |
| 1,483,724 | 2/1924 | Gerner | 340/330 |
| 1,490,740 | 4/1924 | Hielscher | 340/403 |
| 1,606,404 | 11/1926 | Eastman | 340/330 |
| 1,734,678 | 11/1929 | Krogel | 340/326 |
| 2,039,975 | 5/1936 | Nieto | 340/330 |
| 2,343,009 | 2/1944 | Hall | 177/339 |
| 2,712,644 | 7/1955 | Lazzari | 340/330 |
| 2,909,771 | 10/1959 | Mimmich | 340/392 |
| 3,005,919 | 10/1961 | Dias | 307/141.4 |
| 3,530,432 | 9/1970 | Pope | 340/31 |
| 3,964,058 | 6/1976 | Winston | 340/326 |
| 4,079,366 | 3/1978 | Wong | 340/309.4 |
| 4,326,276 | 4/1982 | Scott, Jr. | 368/10 |
| 4,595,978 | 6/1986 | Sheffield | 340/331 |

FOREIGN PATENT DOCUMENTS 2333307 11/1975 France .

*Primary Examiner*—Joseph A. Orsino
*Assistant Examiner*—Jeffery A. Hofsass
*Attorney, Agent, or Firm*—Hubbard, Thurman, Turner & Tucker

[57] ABSTRACT

A programmable doorbell system includes a solid state battery powered doorbell controller for connection to existing doorbell circuitry of a house, three segment display, doorbell control circuit, tone generator, control switches, and power source. The programmable controller includes a clock, memory, bell enable control circuit and display control circuit. The three segment LCD display includes a segment for continously displaying the name of the occupant, and two segments for displaying a selected doorbell answering type message. The doorbell control circuit connects the doorbell to the existing doorbell power circuit. The tone generator provides an audible sound as a message attention getter. The control switches include a manual on/off switch connected to the doorbell enable circuit for overriding the automatic mode of operation, and a mode and a change switch connected to the display control circuit for entering program parameters for the programmable controller. The clock provides the time of day. The memory stores the messages, the time of day (updated every minute), and a doorbell disable and enable time for comparison and provides a disable and an enable signal to the doorbell enable control circuit to control the doorbell control circuit. The display control is connected: to the memory, mode and change switches and coacts with the blinking display for programming the operating parameters including the message selection, the time of day, the disable and enable times, the name of occupant; and to the display for displaying the occupant's name and message.

5 Claims, 2 Drawing Sheets

PROGRAMMABLE DOORBELL CONTROL

This invention relates to controllers and more particularly to a doorbell controller.

BACKGROUND OF THE INVENTION

In the past a doorbell switch, annunciator, and chime device included a case having a lower window for displaying a name card, an upper window for displaying messages, and a doorbell pushbutton switch located between them. A dial was provided around the pushbutton switch; the dial was manually set to identify the expected return time of an absent occupant. Lamps were positioned behind the upper slot for illuminating a photographic film positioned in the upper slot. The photographic film contained the messages the occupant desired to display. The lower slot was designed to receive a name card for display. A two way switch was connected between the pushbutton switch, lights, and chime. The switch could be thrown to a first position to connect the lights to a source of power to illuminate the message and to break the doorbell circuit, and to a second position to turn off the lights and connect the doorbell. Those persons skilled in the art desiring more information of this prior art device are referred U.S. Pat. No. 2,343,009 issued Feb. 29, 1944 to J. A. Hall.

Another prior art device included a musical door chime connected to a clock for annunciating the time. The device includes a read only memory (ROM) for storing a repertoire of musical tunes one of which is displayed when a doorbell pushbutton switch is pressed. The tune to be played is selected by a keyboard connected to a microprocessor. The microprocessor reads from memory each digitally encoded musical note for a note strike and decay circuit. This circuit converts the digital note to analog signals for energizing a loudspeaker. In addition, a clock generates the time for the microprocessor to automatically ring the chimes to indicate the hour of the day. Those persons skilled in the art desiring more information for this device are referred to U.S. Pat. No. 4,326,276 issued Apr. 20, 1982 to W. M. Scott, Jr.

Other prior art doorbell devices of interest includes a door signal regulator circuit which rings the bell at a constant rate regardless of whether the pushbutton is depressed only momentarily or for a long period of time (U.S. Pat. No. 2,909,771 issued Oct. 20, 1959). Another doorbell with hour-of-return indicator, includes a doorbell enabling switch and two dials (hours and minutes) concentrically mounted about the pushbutton switch for setting and lighting the time of return in a window when the doorbell is cut off and enabling the doorbell when non-lettered spaces of the dials are positioned in the window. Still another door signal device includes a key controlled lock switch to provide a visual indication when the occupant is absent and has locked his door. The doorbell is cut off when the door is locked (U.S. Pat. No. 2,039,975 issued May 5, 1936).

Major differences between the prior art devices and the present invention exist. The programmable doorbell control device of the present invention is a low power device connectable to existing household wiring. The device has automatic and manual modes of operation. The automatic mode provides a means of disabling and re-enabling the doorbell by programming the device to perform these functions at a specified time. When disabled the device will display a selected one of a plurality of messages and sound an audible tone when the button is pressed, in order to direct the visitor's attention to the displayed message. When desired the manual mode is selected to override the automatic operation mode. The device continuously displays the name of the party occupying the home.

Thus, a visitor pushing a button hears a tone directing his attention to the display for receiving a message. A repertoire of messages is provided, including a PLEASE KNOCK message to localize the sound when an occupant such as, for example, a baby is sleeping and not to be disturbed. Or, if the occupant is a day time sleeper, a DAYTIME SLEEPER message, or, if the occupant does not want to be disturbed, a DO NOT DISTURB message can be displayed. These differences constitute features which are all advantages over the prior art.

SUMMARY OF THE INVENTION

Accordingly, it is an object of this invention to provide a low cost programmable doorbell control system.

Another object of the invention is to provide a doorbell having automatic and manual operational modes.

Yet another object of the invention is to provide a doorbell having an instructional information message display capability.

Still another object of the invention is to provide a doorbell control system which automatically disables and enables the doorbell at preselected times.

Briefly stated the invention provides a programmable doorbell device for either automatically or manually controlling the operation of a doorbell depending upon the positioning of a mode selection switch.

In the automatic mode, a controller interfaces with the operator, keeps the time of day, controls the enabling and disabling of the doorbell, controls a tone generator, and controls a display. Thus, the occupant enters his name, selects a message for display, sets the clock to the time of day, and sets the times for enabling and disabling the doorbell. When the doorbell pushbutton switch is pressed the tone generator generates a tone for directing a visitor's attention to the display, and the display displays an informational message selected from a repertoire thereof. The name of the house occupant is continuously displayed.

In the manual mode the controller is bypassed and control of the doorbell is returned directly to the doorbell's pushbutton switch.

BRIEF DESCRIPTION OF THE DRAWINGS

Other objects and features of the invention will become more readily understood from the following detailed description of the invention when read in conjunction with the accompanying drawings in which.

DETAILED DESCRIPTION OF A PREFERRED EMBODIMENT

Figure 1:
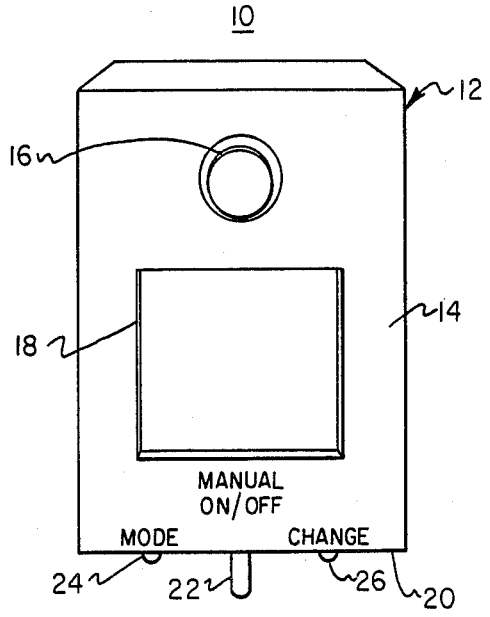
FIG. 1 is an isometric view of the programmable doorbell device.

The programmable doorbell device 10 (FIG. 1) includes a housing 12 having a front panel 14. The front panel includes a pushbutton switch 16 and a display such as, for example, a liquid crystal display 18. The housing 12 also has a bottom 20 having mounted therein control switches including a switch 22 for selecting either the automatic or manual operation mode, a mode pushbutton switch 24 and a change pushbutton switch 26. The mode and change pushbutton switches 24 and 26 are for setting and changing the operational parameters of the programmable doorbell device 10. The housing 12 houses the circuitry including the electronic circuitry for the programmable doorbell device 10.

The electronic circuitry 28 (FIG. 2) for the solid state programmable doorbell device 10 includes a power source 30 connected by leads 32 and 33 for supplying power to a controller 34, liquid crystal display (LCD) 18, and tone generator 36. The power source is separate from the house power supply. It comprises a small inexpensive watch battery; thus, existing electric doorbell switches are replaced without requiring the expertise and expense of an electrician, nor any change in the house wiring. The control switches, including the mode switch 24, change switch 26 and manual switch 22, are typical state-of-the-art switches connected to the controller for purposes hereinafter described. The switches provide a short pulse to a detection circuit. Debouncing circuitry is in the controller to minimize the external component count, and to simplify the manufacturing process.

The controller 34 is connected by bus 42 to the LCD display which includes the display drivers. The LCD display bus 42 includes an 8 bit data bus, a 4 bit address (character select) bus, a strobe signal line to synchronize communication between the display and the display control circuit, and a blink line which, when active high, causes the character being sent to be blinked on the display. In the preferred embodiment, it is not necessary for the display to get data for the messages from the display control circuit; all that is needed is a pointer directing the display to the correct message.

The display 18 is a three segment LCD display of typical LCD display construction. The display includes for example a twelve character display segment for the occupant's name, and two seven character display segments for the information message to be displayed. The controller 34 is also connected by leads 44 and 46, respectively, to the tone generator 36, and doorbell control circuit 48 for control purposes.

The tone generator is a typical tone generator including an oscillator and transducer. When the tone strobe output of the controller becomes active, the oscillator will engage and provide a short tone burst to the transducer for generating an audible frequency suitable for signaling purposes. While, the doorbell control circuit includes an electronic switch, such as, for example, a TRIAC having its gate connected to a bell enable control output of the controller. The TRIAC controls the application of household power to a suitable electric doorbell 50 connected in series therewith. Thus, if the bell enable signal is active and the doorbell button pressed, the bell will ring in the house; otherwise, if the bell enable signal is not active and the button pressed, the bell will not ring.

Figure 3:
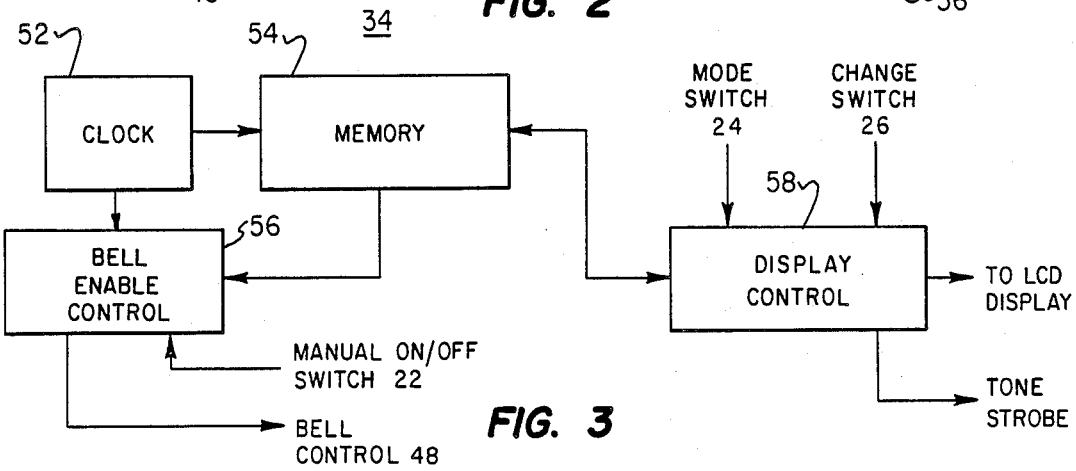
FIG. 3 is a block schematic diagram of the controller for the programmable doorbell device.

Referring now to FIG. 3, the controller 34 includes a clock 52 connected to a memory 54 and a bell enable control circuit 56. The memory 54 is connected to a display control 58 and to the bell enable control circuit 56. The bell enable control circuit 56 is connected to the manual on/off switch 22 and to the bell control circuit 48. The display control 58 is connected to the mode switch 24 and change switch 26 and outputs control signals to the LCD display and tone strobe signals to the tone generator.

The function of the clock 52 is to fetch the present time of day from memory, wait one minute, and write the new time back to the time of day register in memory 54. The clock includes an oscillator and a counter not shown. Once the correct count is observed at the counter output, a minute has expired, causing the memory to be updated with the new time.

The memory 54 stores all of the programmed information. The only parameter which will be altered once the device is programmed is the time of day which changes by the minute.

The display control 58 supplies the custom LCD with the data to be displayed in the twelve character name display. The display 18 (FIG. 2) is used while programming in order to prompt the operator for the required parameters and it also displays the house occupant's name during normal operation. Thus, the data displayed in this segment of the display is changed depending upon the operation mode.

In operation the display control 58 (FIG. 3) provides the LCD with a stream of 12 one-byte ASCII coded characters, a 4 bit decoding nibble, a strobe pulse, and a blink character signal. The display control circuit also provides the display with a 2 bit disable message select signal.

Figure 2:
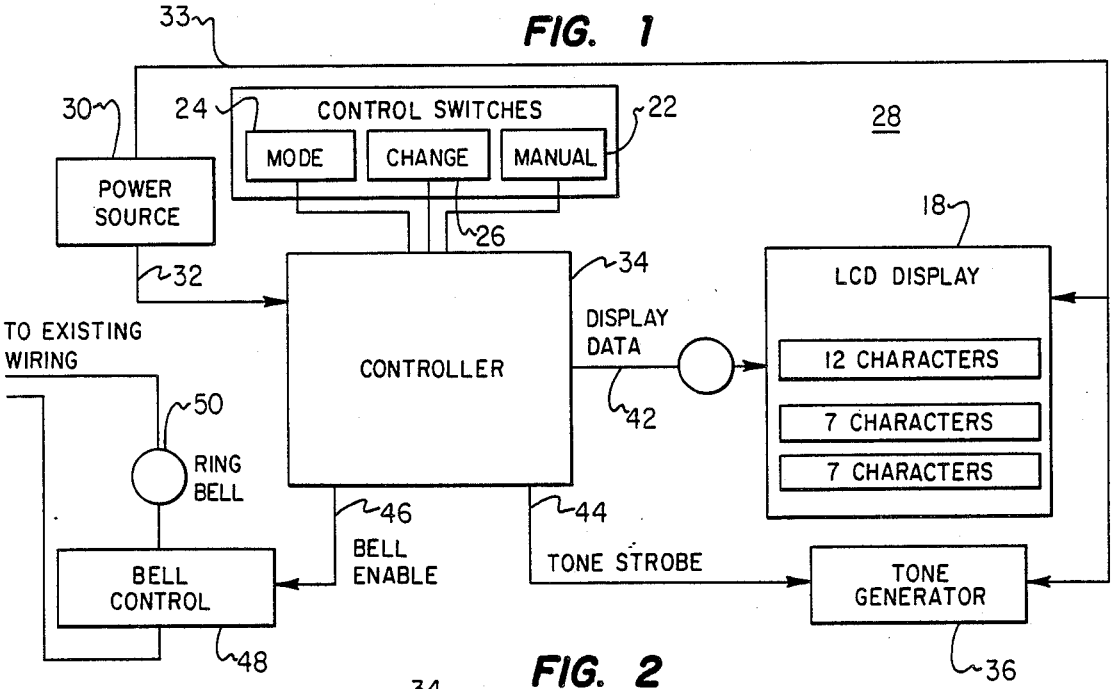
FIG. 2 is a block schematic diagram of the programmable doorbell device circuit.

The display control 58 interfaces with the operator through the mode and change switches 24 and 26 (FIG. 2). The display control circuit (FIG. 3) detects the pressing of the mode switch, and increments the parameter in memory pointed to by an address counter to the next value each time the change switch is pressed. This circuit enters the normal operation mode when the last parameter is entered and the mode switch is pressed. In the normal operation mode the name and message to be displayed are sent to the display 18.

The doorbell enable control circuit 56 fetches the bell disable time and the time of day from memory, compares them and determines if the doorbell should be disabled. Once disabled, the circuit fetches the enable time and the time of day and compares those to determine if the doorbell should again be enabled. Thus, the circuit will provide the doorbell control 48 (FIG. 2) an active high signal at the doorbell enable output when the doorbell is enabled, and an inactive low signal when the doorbell is disabled. The circuit also monitors the manual on/off switch; while in the manual on position, all other functions of this circuit are disabled.

FLOWCHART

Figure 4:
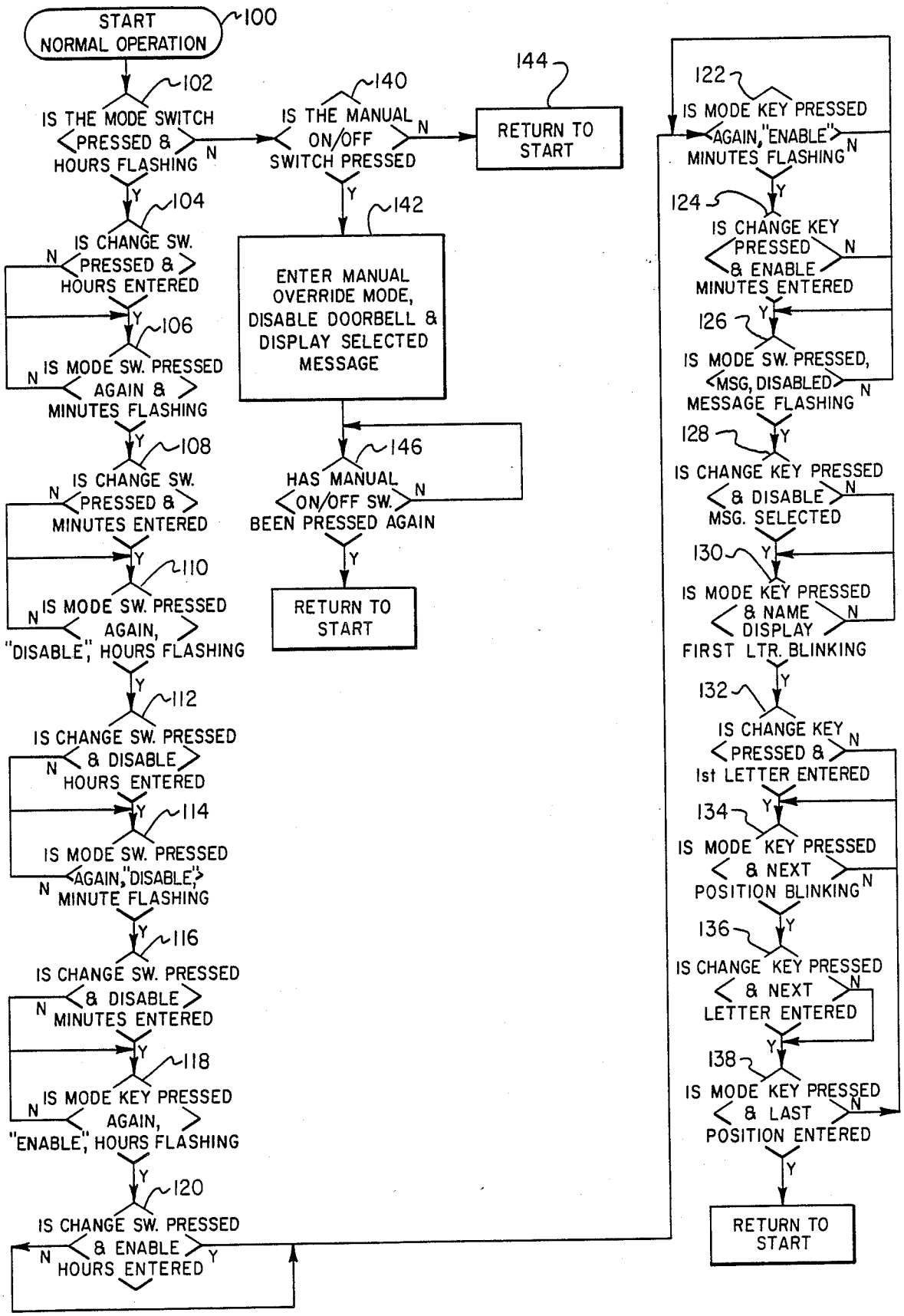
FIG. 4 is a flowchart for setting the operational parameters of the programmable doorbell device.

The programming of the controller is described in connection with a flowchart (FIG. 4) as follows.

At start 100, with the doorbell in normal operation, to set or correct the clock's time-of-day, a decision 102 is made whether the mode switch has been pressed and the hours display blinking; else a manual on/off switch subroutine beginning with decision 140 is entered. If decision 102 is yes, a decision 104 is made whether the change switch has been pressed and the hour entered; if yes, a decision 106 is made whether the mode switch has been pressed again, else the decision 106 is made directly whether the mode switch has been pressed again. When decision 106 is yes, a decision 108 is made whether the change switch has been pressed and minutes entered; if yes, a decision 110 is made whether the mode switch has been pressed, a "DISABLE" message displayed and hours flashing; else decision 110 is made directly.

When decision 110 is yes, the mode switch has been pressed again, a "DISABLE" message displayed and the disable hour display blinking, a decision 112 is made whether the change switch has been pressed and the disable hour entered; if yes, a decision 114 is made whether the mode switch has been pressed, the "DISABLE" message displayed, and the disable minutes display blinking, else the decision 114 is made directly. When decision 114 is yes, a decision 116 is made whether the change switch has been pressed and the disable minutes entered; if yes, decision 118 is made whether the mode key has been pressed an "ENABLE" message displayed, and the enable hours display blinking, else decision 118 is made directly.

When decision 118 is yes, the mode key has been pressed and the enable hours display is blinking, a decision 120 is made whether the change switch has been pressed and enable hours entered; if yes, a decision 122 is made whether the mode key has been pressed, the "ENABLE" message displayed and the enable minutes display blinking, else decision 122 is made directly. When decision 122 is yes, a decision 124 is made whether the change switch has been pressed and the enable minutes entered, if yes, a decision 126 is made whether the mode switch has been pressed a "MESSAGE" message displayed and the disabled message display blinking, else the decision 126 is made directly. When decision 126 is yes, a decision 128 is made whether the change key has been pressed and the disable message selected; if yes a decision 130 is made whether the mode switch has been pressed and the first letter of the name display blinking; else decision 130 is made directly.

When decision 130 is yes, a decision 132 is made whether the change key has been pressed and a first letter entered. If decision 132 is yes, a decision 134 is made whether the mode switch has been pressed and the next letter position blinking; else decision 134 is made directly. If decision 134 is yes, a decision 136 is made whether the change key has been pressed and the next letter entered. When decision 136 is yes, a decision 138 is made whether the mode key has been pressed and the last position entered; else decision 138 is made directly. When decision 138 is yes, return is made to start, else return is made to step 134 and steps 134, 136, and 138 repeated until decision 138 is yes and return is made to start (normal operation).

Returning now to decision 140, the manual on/off switch subroutine begins with the decision 140 as to whether the manual on/off switch is in the on position; if yes, an instruction 142 is issued to override the mode, disable doorbell, and display selected message; else an instruction 144 is issued to return to start 100. After instruction 142 is issued, a decision 146 is continuously made to determine whether the manual on/off switch has been pressed again; if yes, return is made to start, else the decision 146 is continuously made until the decision is yes and return is made to start for normal operation.

It will be appreciated by those skilled in the art that this flowchart logic can be implemented using the state-of-the art gate array technology. Thus, with the clock set to the correct time, the doorbell disable time and enable time entered correctly, the message to be displayed selected, and the occupant's name entered the doorbell controller is ready for operation.

In operation, when a visitor arrives he finds the occupant's name displayed to ensure he is at the correct address. When the visitor presses the doorbell pushbutton switch, a tone will direct attention to the message display. If the visitor has arrived during the time the doorbell is disabled, the message will advise the visitor whether to knock on the door, not disturb the occupant, or that the occupant is a daytime sleeper. These messages, though typical, are examples only and these and additional or other messages can be programmed into the system at the factory level. In a more sophisticated embodiment, the occupant, can enter desired messages in the same manner the occupant's name is entered. Should the occupant for any reason desire normal operation during the disable period, the manual on/off switch can be pressed to override the controller. Automatic control is again established by pressing the manual on/off switch once again.

Although a single embodiment of the invention has been described, it will be apparent to one skilled in the art that various modifications to the details of construction shown and described may be made without departing from the scope of this invention.

What is claimed is:

1. A programmable doorbell system comprising in combination:

a doorbell control means for connecting a doorbell to a power source for ringing the doorbell;

a solid state display means for displaying information; a manual on/off mode selection means for selecting either manual or automatic operation of the doorbell system; a programming/normal mode selection means for selecting either a programming mode for programming the automatic operating mode or a normal mode for running the automatic mode program; an entry means for entering program information during the programming mode; and a programmable controller means for receiving program information and controlling the operation of the doorbell system in response to the program information;

said programmable controller means including: a memory means for storing information including doorbell answering type messages; a clock means connected to the memory means for providing and incrementing the time of day for storage in the memory, a display control means including means connected to the programming/normal mode selection means for monitoring programming or normal mode selection, means connected to the entry means for receiving and storing in the memory means during the programming mode information including an occupant's name, time of day, doorbell enabling and disabling times and identification of doorbell answering type messages to be displayed during the enabling and disabling times, and means connected to the display means for displaying during the programming mode the information being entered into the memory means, and means connected to the display means and memory means during the normal mode for fetching and displaying the occupant's name, and means for fetching the time of day for comparison with the times for enabling and disabling a doorbell and displaying a doorbell answering type message; and a doorbell enable control means including means connected to the manual on/off selection means for monitoring the manual on/off selection means for manual or automatic operation, and means connected to the memory means during the automatic operation mode for fetching doorbell enabling and disabling times and the time of day for comparison and determining whether the doorbell should be enabled or disabled and means connected to the doorbell control means for selectively enabling and disabling the doorbell control means, and means connected during the manual operation mode to the manual on/off mode selection means for monitoring the on/off mode selection for enabling the doorbell control means for manual operation.

2. A programmable doorbell system according to claim 1 wherein the selected doorbell answering type message is selected from a group of memory stored messages consisting of "DO NOT DISTURB", "DAY-TIME SLEEPER" and "PLEASE KNOCK".

3. A programmable doorbell system according to claim 1 wherein the display means for displaying the occupant's name includes a display segment for continuously displaying the name of the occupant.

4. A programmable doorbell system comprising:

a doorbell;

a housing having a front panel and a compartment;

a doorbell ringing push button switch and a display means for displaying information including program parameters and messages, the doorbell ringing push button switch and display means being mounted in the front panel; a programmable controller means for controlling operation of the doorbell system, and a plurality of circuits including sensor and action circuits mounted in the compartment; and a manual on/off switch connected by a first sensor circuit to the programmable controller for selecting either an automatic or a manual operating mode, and when in the automatic mode, a mode push button switch connected by a second sensor circuit to the programmable controller for selection during the automatic mode either a normal operating mode or a programming mode, a change push button switch connected by a third sensor circuit to the programmable controller for entering information during the programming mode;

said programmable controller having a time of day clock means for producing the time of day, a memory means for storing programmed information including times for enabling and disabling power to the doorbell ringing push button switch, said memory means having a time of day register connected to the clock means, said clock means for fetching the time of day from the time of day register, waiting for the correct count for one minute and writing the new time of day back to the time of day register;

a power source connected to the display means and programmable controller;

a doorbell ringing action circuit for connecting an electric doorbell to the programmable controller and including an electronic switch for selectively connecting power to the doorbell ringing push button switch and a doorbell enable control means connected to the programmable controller for controlling operation of the electronic switch;

said doorbell enable control means being connected to the manual on/off switch, electronic switch and to the memory means during manual off selection for fetching the doorbell disable time and the time of day from memory for comparison and determining if the doorbell should be disabled, and once disabled for fetching the enable time and the time of day for comparison and determining if the doorbell should be enabled again, and during manual on selection only for monitoring the position of the manual on/off switch for a change in position and to the electronic switch for connecting power to the doorbell ringing push button switch for manual operation of the doorbell; and a display control action means connected to the memory means and display means and responsive to the normal/programming mode being in the programming mode and the change switch being pressed for displaying programming prompts received from the memory means for the required program parameters including those for setting the clock, entering the doorbell enabling and disabling times, and entering the occupant's name and messages, and responsive to the pressing of the change switch for entry of the program parameters and at the end of the programming mode or responsive to the normal/programming mode switch actuation whichever first occurs for entering the normal operation mode and said display control action means and display means in the normal mode being responsive to the pressing of the doorbell push button for fetching and displaying the occupant's name and message selected for the enabling and disabling times.

5. A programmable doorbell system comprising:

a doorbell;

a housing remotely positioned as to the doorbell;

a doorbell ringing switch, a manual on/off switch, a normal/programming mode selection and a data entry switch, a tone generator, a solid state display, and a programmable controller including a clock, a storage means and a plurality of control circuits operatively mounted in said housing;

said plurality of control circuits including a doorbell ringing circuit connecting the programmable controller to the doorbell ringing switch and responsive to a pressing of the doorbell ringing switch for ringing the doorbell; an electric doorbell enabling circuit connecting the programmable controller to the manual on/off switch and doorbell ringing circuit and operative during manual off selection for continuously fetching the time of day from the clock for comparison, respectively, with programmed disabling and enabling times stored in memory and selectively disabling and enabling the doorbell ringing circuit, and operative during manual on selection for continuously monitoring the position of the manual on/off switch for controlling the doorbell ringing control circuit to supply power to the doorbell ringing switch continuously while in the manual on position; a tone strobe circuit connecting the controller to the tone generator for producing a tone concomitantly with the ringing of the doorbell for directing attention to a display message being displayed; and a display control circuit connecting the programmable controller to the normal/programming mode and data entry switches and to the display, said display control circuit in the programming mode being responsive to the pressing of the mode switch for displaying sequentially programming prompts for entering required program instructions, and doorbell answering type messages in the memory responsive to the pressing of the data entry switch, and in the normal mode for determining the time and fetching a corresponding message for display responsive to the programmed instructions.

* * * * *